US009555293B2

(12) United States Patent
Anderson et al.

(10) Patent No.: US 9,555,293 B2
(45) **Date of Patent: *Jan. 31, 2017**

(54) GOLF CLUB HAVING A HOLLOW PRESSURIZED METAL HEAD

(71) Applicants: Donald A Anderson, Huntington Beach, CA (US); Babek Khamenian, Costa Mesa, CA (US); Alden J Blowers, Pasadena, CA (US)

(72) Inventors: Donald A Anderson, Huntington Beach, CA (US); Babek Khamenian, Costa Mesa, CA (US); Alden J Blowers, Pasadena, CA (US)

(73) Assignee: ALDEN J. BLOWERS, Pasadena, CA (US)

( * ) Notice: Subject to any disclaimer, the term of this patent is extended or adjusted under 35 U.S.C. 154(b) by 193 days.

This patent is subject to a terminal disclaimer.

(21) Appl. No.: 14/195,831

(22) Filed: Mar. 3, 2014

(65) Prior Publication Data

US 2014/0338785 A1 Nov. 20, 2014

Related U.S. Application Data

(63) Continuation of application No. 12/027,156, filed on Feb. 6, 2008, now Pat. No. 8,663,026.

(60) Provisional application No. 60/899,951, filed on Feb. 7, 2007.

(51) Int. Cl.
*A63B 53/04* (2015.01)
*A63B 53/08* (2015.01)

(52) U.S. Cl.
CPC ..... *A63B 53/0466* (2013.01); *A63B 53/0475* (2013.01); *A63B 53/08* (2013.01); *A63B 60/42* (2015.10); *A63B 2053/0433* (2013.01); *A63B 2053/0491* (2013.01); *A63B 2209/00* (2013.01); *Y10T 29/49986* (2015.01)

(58) Field of Classification Search
USPC ..... 473/324–350
See application file for complete search history.

(56) References Cited

U.S. PATENT DOCUMENTS 3,782,682 A * 1/1974 Lale ..... F15C 1/002 137/624.18
3,817,522 A * 6/1974 Simmons ..... A63B 53/04 273/DIG. 3
3,844,311 A * 10/1974 McSwain ..... F16K 21/06 137/624.11

(Continued)

FOREIGN PATENT DOCUMENTS

FR 2640880 A1 * 6/1990 ..... A63B 53/04
GB 2008954 A * 6/1979 ..... A63B 37/14

(Continued)

*Primary Examiner* — Alvin Hunter
(74) *Attorney, Agent, or Firm* — Blakely Sokoloff Taylor & Zafman LLP

(57) ABSTRACT

A method for manufacturing a golf club having a hollow golf club head which is filled with a gas under pressure. The interior surface of the golf club head is coated with a solidified layer of a sealant material. The pressurized gas permits the use of thinner face plates by compensating for forces generated when the face plate strikes a golf ball. The sealant is preferably applied by rotating the golf club head to coat the interior surface of the golf club head.

4 Claims, 8 Drawing Sheets

(56) References Cited

U.S. PATENT DOCUMENTS 3,993,314 A * 11/1976 Harrington ..... A63B 49/00 473/326
4,022,469 A * 5/1977 Lacoste ..... A63B 39/06 273/DIG. 10
4,102,624 A * 7/1978 Corona ..... B29C 41/06 264/311
4,244,494 A * 1/1981 Colgate ..... A01M 7/0092 137/564.5
4,307,133 A * 12/1981 Haselier ..... C09D 123/06 427/195
4,526,916 A * 7/1985 White ..... C08F 255/02 524/128
4,575,447 A * 3/1986 Hariguchi ..... B29C 49/22 264/512
4,591,160 A * 5/1986 Piragino ..... A63B 53/04 273/DIG. 1
4,651,799 A * 3/1987 Chandley ..... B22C 9/08 164/246
4,718,670 A * 1/1988 Gray ..... A63B 71/0605 473/570
4,925,044 A * 5/1990 Hembert ..... F17C 1/12 220/589
5,008,137 A * 4/1991 Nugent, Jr. ..... C08G 59/184 428/35.4
5,037,600 A * 8/1991 Upchurch ..... B28B 19/0023 264/113
5,039,780 A * 8/1991 Hashimoto ..... B29C 49/0005 525/437
5,064,197 A * 11/1991 Eddy ..... A63B 53/04 473/326
5,263,713 A * 11/1993 Taylor ..... A63B 53/04 273/DIG. 29
5,401,030 A * 3/1995 Halliburton ..... A63B 69/3614 473/220
5,410,798 A * 5/1995 Lo ..... A63B 53/04 264/241
5,465,969 A 11/1995 Cadorniga
5,524,698 A * 6/1996 Chen ..... B22C 1/00 164/138
5,540,625 A * 7/1996 Koch ..... A63B 53/00 473/318
5,632,693 A * 5/1997 Painter ..... A63B 53/00 473/318
5,637,045 A * 6/1997 Igarashi ..... A63B 53/04 273/DIG. 8
5,643,111 A * 7/1997 Igarashi ..... A63B 53/04 273/DIG. 8
5,766,091 A * 6/1998 Humphrey ..... A63B 53/04 164/132
5,813,931 A * 9/1998 Gormley ..... A63B 43/00 473/575
5,904,628 A * 5/1999 MacKay, Jr. ..... A63B 53/00 473/300
6,019,687 A * 2/2000 Blowers ..... A63B 53/04 473/326
6,096,401 A 8/2000 Jenkines
6,180,203 B1 * 1/2001 Unkles ..... B29C 41/04 108/51.11
6,232,389 B1 * 5/2001 Feeney ..... B60C 1/00 427/245
6,723,279 B1 * 4/2004 Withers ..... A63B 53/04 419/12
6,902,495 B2 * 6/2005 Pergande ..... A63B 53/047 473/329
6,991,559 B2 * 1/2006 Yabu ..... A63B 53/04 473/332
7,108,614 B2 * 9/2006 Lo ..... A63B 53/0466 473/345
7,150,692 B2 * 12/2006 Hong ..... A63B 59/70 280/601
7,281,988 B2 * 10/2007 Hou ..... A63B 53/0466 473/326
7,281,989 B2 * 10/2007 Hou ..... A63B 53/0466 473/326
7,281,991 B2 * 10/2007 Gilbert ..... A63B 53/0466 473/335
7,326,127 B2 * 2/2008 Hou ..... A63B 53/0466 473/326
8,663,026 B2 * 3/2014 Blowers ..... A63B 53/0466 473/326
2005/0009626 A1 * 1/2005 Imamoto ..... A63B 53/047 473/338
2005/0124437 A1 * 6/2005 Imamoto ..... A63B 53/04 473/346
2005/0277485 A1 12/2005 Hou et al.
2006/0223652 A1 10/2006 Hou
2006/0229140 A1 10/2006 Kubica et al.
2007/0155532 A1 * 7/2007 Adams ..... A63B 53/0466 473/324
2009/0298610 A1 * 12/2009 Tseng ..... A63B 53/0466 473/332

FOREIGN PATENT DOCUMENTS

GB 2 247 628 A 3/1992
GB 2247628 A * 3/1992 ..... A63B 53/04
GB 2 427 005 A 12/2006
JP Sho 59-189877 10/1984
JP 61068213 A 4/1986
JP 646973 1/1989
JP 01256980 A * 10/1989
JP 3007178 A 1/1991
JP 1993-009943 1/1993
JP 06064564 A * 3/1994
JP 07008580 A * 1/1995
JP 7068575 A 3/1995
JP 07213655 A * 8/1995
JP 08024377 A * 1/1996
JP 08224326 A * 9/1996
JP 09084905 3/1997
JP 09084905 A * 3/1997
JP 9280177 A 10/1997
JP 10076028 A * 3/1998
JP 2000116824 A * 4/2000
JP 2002102395 A * 4/2002
JP 2002253708 A * 9/2002
JP 2002336389 A * 11/2002
JP 2002336390 A * 11/2002
JP 2004081793 A * 3/2004
JP 2004277556 A * 10/2004
JP 2005052314 A * 3/2005
JP 2006000135 A 1/2006
JP 2006223471 A * 8/2006
WO WO 98/56470 12/1998

* cited by examiner

GOLF CLUB HAVING A HOLLOW PRESSURIZED METAL HEAD

STATEMENT OF RELATED APPLICATION

This application claims priority to provisional U.S. Patent Application No. 60/899,951, filed Feb. 7, 2007, the disclosure of which is incorporated herein by reference.

BACKGROUND OF THE INVENTION

1. Field of the Invention

This invention relates generally to golf equipment and more particularly to a golf club having a hollow club head filled with fluid under pressure so that the club head may have a face plate which will withstand deflection during impact with the golf ball.

2. Background of the Art

It is well known that all golfers struggle to improve their scoring during a game of golf. As part of this, changes in golf club manufacturing have improved the technology to allow golfers to utilize drivers and fairway metal woods to gain a longer distance off the tee or down the fairway. As examples of the improved technology, such golf clubs are available at the present time which are lighter in weight, are impact resistance, are manufactured from titanium or stainless steel, have shafts which are tailored to various swing speeds, have increased head size and the like.

It is also recognized among golfers that with a given club the golfer having a faster swing speed will generate more distance than a golfer having a slower swing speed. As a result, even though there has been vast improvements in golf club head technology to assist golfers no attempt has been made (other than shaft design) to allow a golfer with a lower swing speed to achieve the benefits of the improved golf club head technology in a manner which has occurred with the golfers having much higher swing speeds. At the same time if golf club head technology can allow golfers with lower swing speeds to achieve longer distance with a club, such technology also may be utilized to allow the golfers with higher swing speeds to achieve an even greater distance than is available with technology at the present time.

Therefore, it would be desirable to provide a golf club with a golf club head manufactured using technology that would allow greater distance and accuracy while remaining within the design criteria limits established by the United States Golf Association (USGA). Such golf clubs would be drivers, fairway clubs, hybrid clubs and irons.

SUMMARY OF THE INVENTION

A hollow metal golf club head having the interior thereof filled with a gas under pressure and having the interior surface thereof coated with a thermoplastic material acting as a sealant adapted to prevent the pressurized gas from passing through pores formed in the golf club head. The golf club head includes a valve which is disposed within a cavity formed at the time of manufacture of the club head preferably in the lower rear portion of the sole of the club head and which includes a spring-loaded member which is sealed against a surface within the cavity and which member may be moved away from its sealed position to allow gas under pressure to enter the hollow interior of the club and then restored to the sealed position to retain the gas under pressure within the hollow interior of the club.

A method of manufacturing a golf club head including providing a hollow golf club head having an interior surface, inserting particles of a thermoplastic material into the hollow interior, heating the club head to a temperature equal to at least the melting point of the thermoplastic material, rotating the head, while maintaining the temperature thereof, simultaneously through a vertical and a horizontal axis to coat the interior surface thereof with the melted thermoplastic material, and cooling the club head to solidify the thermoplastic material.

In accordance with a further aspect of the present invention the interior surface of the hollow club head is covered by a plastic material which is coated upon the interior surface of the club head by rotational molding to thus apply a continuous plastic surface that will seal the interior surface of the club head to prevent the escape of the gas under pressure contained therein.

In accordance with yet a further aspect of the present invention hollow metal golf club heads including metal woods and irons having face plates on the order of 1.0 millimeters to 7.0 millimeters containing a compressed gas therein having a pressure on the order of 20 to 300 pounds per square inch are provided and tailored for swing speeds between 40 mph and 160 mph.

In accordance with yet another aspect of the present invention the face plate of a hollow pressurized golf club head may have regions thereof displaced from the central striking zone of the face plate reduced in thickness to provide a greater "sweet spot" or several "sweet spots" on the club face, each being supported by the pressurized gas.

In accordance with an additional aspect of the present invention, there is provided a gas charging system which is connected between a source of gas under pressure and a valve contained within a hollow metal golf club head which includes an actuator for moving the valve from a closed to an open position to permit gas under pressure to fill the hollow interior of the golf club and to allow the valve to move from an open to a closed position to retain the gas under pressure within the hollow golf club head.

DETAILED DESCRIPTION

Figure 1:
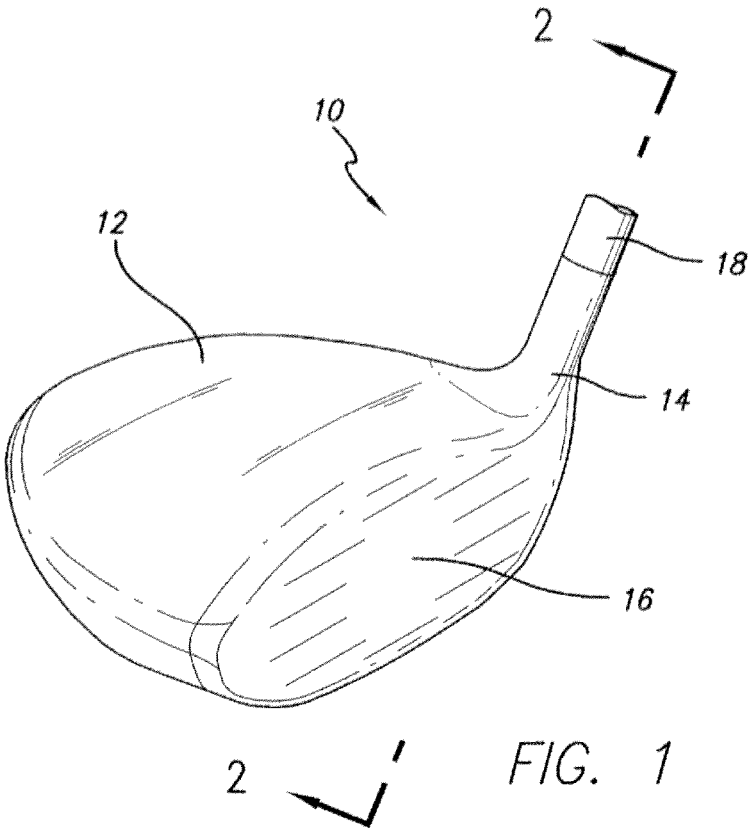
FIG. 1 is a schematic illustration of a golf club head constructed in accordance with the principles of the present invention.

The present invention is an improvement over the golf club having a hollow air filled head as disclosed and claimed in U.S. Pat. No. 6,019,687 issued Feb. 1, 2000 to Alden J. Blowers, one of the co-inventors named herein, which by this reference is incorporated herein insofar as the same is not contrary to the disclosure and claims relating to the present invention.

To accommodate golfers desiring to hit the golf ball a further distance with drivers and fairway woods, the golf manufacturing technology has provided metal golf club heads commonly referred to as metal woods. The technology has progressed through the utilization of forged metal face plates which are fitted to molded metal bodies. Such bodies may be formed from titanium or steel and the face plates may likewise be formed from titanium or steel depending upon the particular application. Typically, a titanium molded body must be utilized to receive a titanium forged face plate. The USGA has imposed specific limitations as to the size of the head, the coefficient of restitution (COR) of the face plate, the moment of inertia and the like. Typically, the coefficient of restitution for a club face on a driver cannot exceed 0.830 and the volume of the driver cannot exceed 460 cubic centimeters with a tolerance of plus 10 cc. It has been found when the club face is reduced to a thickness below approximately 2.8 millimeters that a golfer having a high swing speed (for example, in excess of 95 to 100 mph) can damage the club face by bending it or in some instances if the club head speed is fast enough actually fracturing the club face upon impact of the ball on the club face. On the other hand, it has also been determined that as the club face gets thinner, the golfer is able to generate more velocity of the golf ball leaving the club face at the same club head speed thereby causing the ball to travel farther. It is for this reason that the COR maximum was instituted by the USGA.

At the present time, little or no attention has been paid to the average golfer who has a swing speed substantially less than the 90 mph which is usually the lower limit of the better golfers. For example, the typical woman golfer will have a club head speed on the order of 55 to 60 mph and junior golfers may have a swing speed starting at 40 mph. With such a club head speed utilizing the 2.8 millimeter thickness of the typical club face will not produce the desired results which are generally sought after and achieved only by the golfers having the high club head swing speeds. There is therefore needed a system whereby a thinner club head face, on the order of 1.0 to 2.2 millimeters, may be used which will allow the golfer having a low club head speed to generate greater distance and to achieve the benefits of the present technology. However, such a thin club face even at lower club head speeds can still generate problems with the COR and potential damage to the club face.

By utilizing the principles of the present invention and pressurizing the internal volume of the club head by utilization of a compressed gas, the forces generated on the club face by the club head striking the golf ball even with a very thin club face can be compensated for, thus providing the ability for the golfer to utilize the thinner club face, thus generating more ball velocity off the club face but at the same time not damaging the club face or violating the COR restrictions.

Figure 2:
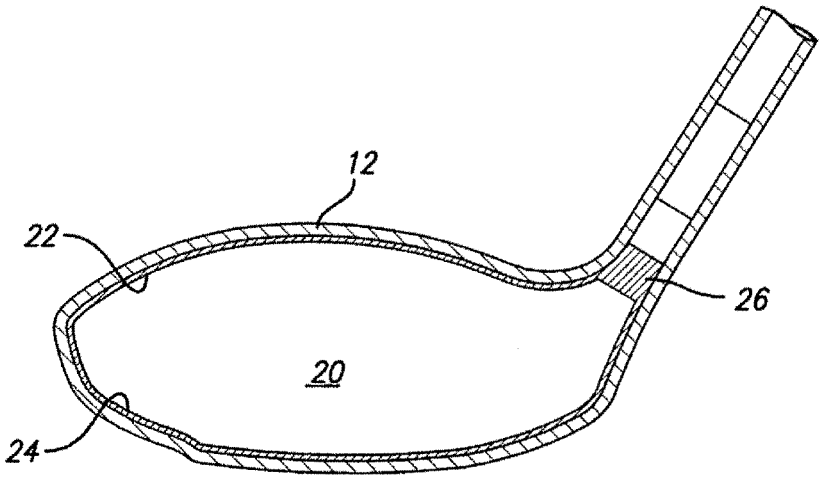
FIG. 2 is a cross-sectional view of the golf club head of FIG. 1 taken about the lines 2-2 of FIG. 1.

Referring now to the drawings and more particularly to FIGS. 1 and 2, there is illustrated a golf club head made in accordance with the principles of the present invention. Illustrated in FIG. 1 is a metal wood such as a driver which is typically used by a golfer to drive a golf ball a long distance off the tee. The metal wood golf club 10 includes a head 12 having a hosel 14 and a club face 16. A shaft 18 is connected to the hosel 14 and is gripped by the golfer to manipulate the club 10 to cause the club face 16 to strike a golf ball and propel it down the fairway. When a golf club such as that shown in FIG. 1 is used to strike a golf ball, the golf ball stays in contact with the club face 16 approximately 450 micro-seconds and upon impact exerts an average force of approximately 2000 lbs. on the golf ball. Typically a golf club head of the type shown in FIG. 1 is manufactured from titanium or stainless steel utilizing a metallic casting. A club face 16 is generally formed separately from the remainder of the club head and is then welded in place on the club head 12. The club face may be forged, although such is not required. Typically, if the club face is of forged titanium, the club head 12 will be formed from cast titanium so that the metals are compatible for welding. Similarly, if the forged club face 16 is made of stainless steel, the club head 12 will also be made of cast stainless steel. It should be recognized that the entire club head may be formed by casting without departing from the scope of the present invention.

As above indicated, the technology of the invention herein disclosed has resulted in the ability to make the club face 16 thinner and to allow greater force to be applied to the golf ball causing it to travel further when it is impacted by the club head. However, as the club face 16 gets thinner, the large amount of force exerted upon impact with the golf ball can destroy the club face 16. To preclude this occurring, the club head 12 is hollow as illustrated in FIG. 2 and in accordance with the principles of the present invention, the hollow interior 20 is filled with compressed gas having sufficient pressure to support the thin club face. Various compressed gases including air may be utilized, however, in accordance with a preferred embodiment of the present invention nitrogen is utilized. Nitrogen is preferred because the molecules of nitrogen are larger in size than many other gases and thus will not as easily migrate through the pores in the cast club head as would gases having smaller molecules.

In accordance with the principles of the present invention the interior surface 22 of the hollow club head 12 is covered with a sealant 24 to further preclude the compressed gas from escaping through the pores in the cast material. As is also illustrated in FIG. 2, the opening from the hollow interior of the club head into the hosel 14 is plugged at the time of formation by a plug 26 which preferably is formed as a integral part of the casting of the club head. The coating 24 on the interior surface used to seal the club head 12 may be formed by rotational molding using a thermoplastic resin. Any thermoplastic resin which will adhere to the interior surface of the hollow club head and which will expand and contract with movement of the club head as a result of temperature changes may be utilized. For example, cross linked or high density polyethylene may be used and in accordance with a preferred embodiment of the present invention, a polyurethane resin functions adequately. Rotational molding takes place by melting a thermoplastic resin in powder or pellet form in a bi-axially rotating heated mold. In accordance with the present invention the hollow club head could be the mold. Alternatively, a plurality of hollow club heads, each containing the granular thermoplastic resin, may be supported internally of a chamber on a frame which is bi-axially rotated or the entire heated chamber may be rotated with the heads mounted thereon. The particles of thermoplastic resin melt and puddle in the bottom of the hollow club head. As the club head is rotated simultaneously through a vertical and a horizontal axis, the interior surface of the club head passes through the puddle of thermoplastic material causing a thin layer of the material to coat the inner surface of the hollow club head and fuse thereto in layers. This process continues with the fused layer becoming progressively thicker until the desired wall thickness of the coating on the interior surface of the hollow club head is achieved. Under some circumstances the interior surface of the hollow club head may need to be cleaned, such as degreasing, prior to the rotational molding. Such cleansing assures adherence of the plastic coating to the club head. By providing such a coating on the interior surface 22 of the hollow club head 12 all of the pores which may exist in the molded club head 12 are closed or covered thereby retaining the pressurized gas internally of the club head without substantial leakage.

Figure 3:
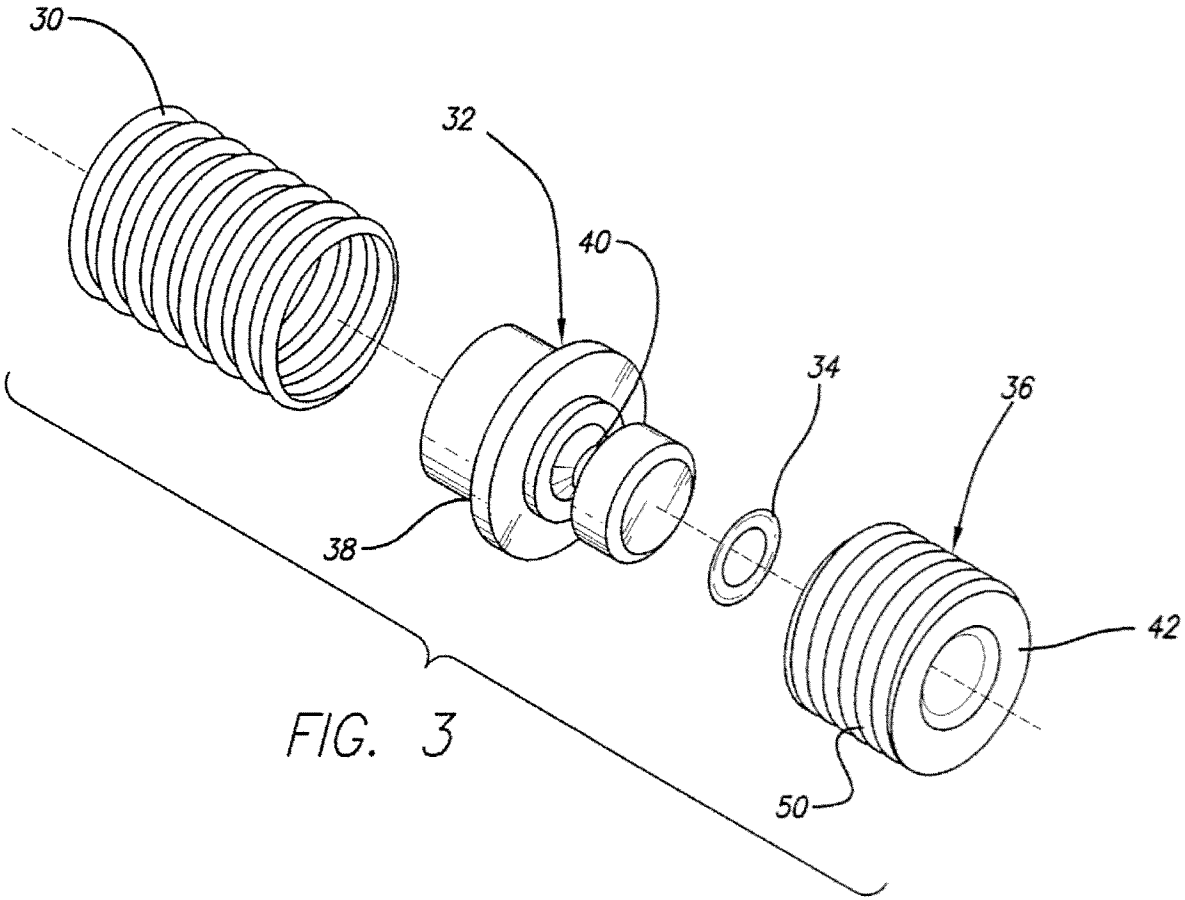
FIG. 3 is an exploded view showing the structural components of the valve incorporated into the head as shown in FIG. 1.
Figure 4:
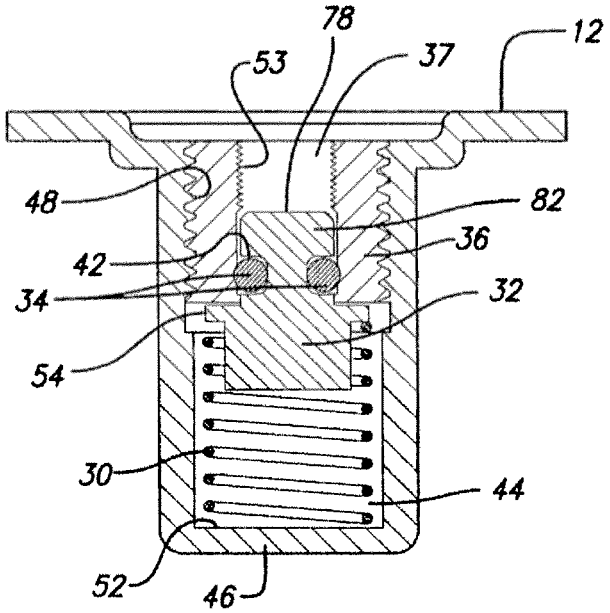
FIG. 4 is a cross-sectional view of a valve incorporated into a golf club head in accordance with the principles of the present invention.

By referring now to FIGS. 3 and 4 there is illustrated a valve and the manner in which it is retained within the club head 12. The valve is utilized to pressurize the hollow interior 20 of the club head 12. FIG. 3 illustrates an exploded view of the components of the valve. The valve includes a spring 30, a valve core or plunger 32, an o-ring 34, and a retainer or body 36. The spring 30 engages a surface 38 on the stem 32 while the o-ring 34 is situated within the groove 40 of the stem 32. The o-ring engages a surface 42 formed on a bore through the retainer 36 and effectuates a seal to retain the pressurized gas within the hollow interior 20 of the club head 12. The manner in which the components shown in FIG. 3 are retained within the club head is illustrated in FIG. 4. The structure as shown in FIG. 4 may be formed at any position desired within the club head but for a driver it is preferred to be at the center rear thereof adjacent to or on the sole to assist in performance of the club as to launch angle and center of gravity. The club head 12 at the time of molding is formed with a cavity 44 which includes an opening 46 through which compressed gas passes. The interior surface 48 of the initial portion of the opening 44 is threaded and receives the external threads 50 formed on the retainer 36. The threads may be tapered or straight. The threads 50 mate with the threads on the surface 48 in such a manner than an airtight seal is formed. The spring 30 is seated against the bottom portion 52 of the cavity 44. The stem 32 is deposited on the end 54 of the spring 30. When the stem 32 is positioned on the end 54 of the spring 30, it is pushed downwardly by inserting the retainer 36 into the cavity 44 and engaging the threads 50 with the threads on the interior surface 48 of the cavity. The retainer is then threaded until it is seated in position as shown in FIG. 4. When such is done, the o-ring 34 will form the seal between the stem 32 and the surface 42 of the retainer 36. The bore 37 in the retainer 36 is threaded as shown at 53 to receive a tool (not shown) to assist in threading the retainer 36 into the cavity.

Figure 4A:
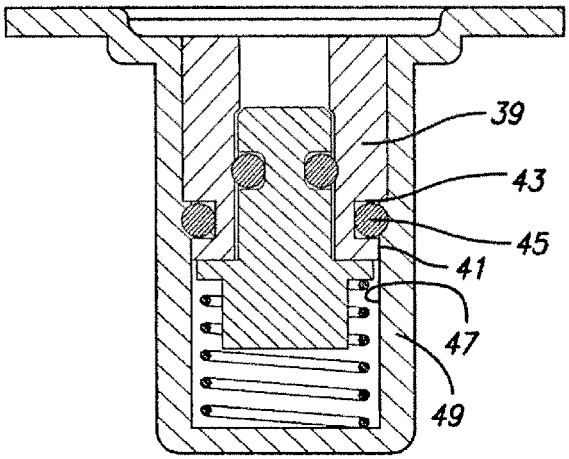
FIG. 4A is a partial cross-sectional view of an alternative embodiment of the valve.

FIG. 4A illustrates a preferred alternative embodiment of the valve as installed in the golf club head. The structure is substantially the same as shown in FIG. 4 and above described except for the retainer 36. As illustrated in FIG. 4A, the retainer 39 includes an unthreaded extension 41 which defines a groove 43 therein. Seated within the groove 43 is an additional "O" ring 45 which seats against the wall 47 of the cavity 49. The additional "O" ring 45 is an added safety feature to prevent leakage of the pressurized To insert gas under pressure into the hollow interior 20 of the club head 12 the valve stem is moved from the position shown in FIG. 4 (the closed position) against the force of the spring 30 to allow gas to pass by the stem 32 and through the opening 46 into the hollow interior 20 of the club head 12. When the gas has reached the desired pressure, the stem is allowed to return to the position shown in FIG. 3 and once again to seal the cavity 44 to preclude the pressurized gas from exiting the hollow interior 20 of the club head 12.

Figure 6:
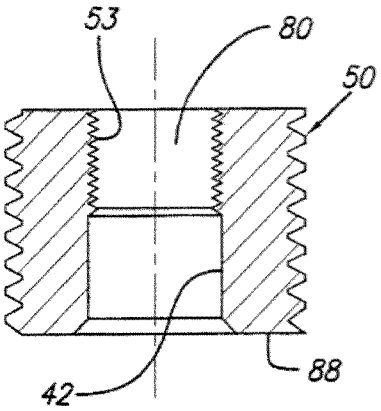
FIG. 6 is a cross-sectional view of the retainer shown in FIG. 5 taken about the lines 6-6 thereof.
Figure 5:
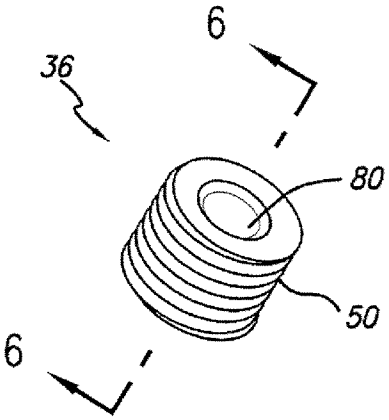
FIG. 5 is a perspective view of a retainer used in such valve.

Referring now more particularly to FIGS. 5 and 6, the retainer 36 is shown in greater detail. As is therein illustrated, the retainer 36 having the threads 50 formed on the external surface thereof defines a bore 80 therethrough. As is shown in FIG. 6 the initial portion of the bore 80 has the threads 53 formed therein. The lower portion of the bore 80 has a larger diameter than does the initial portion and receives the head 82 of the stem 32 as is illustrated in FIG. 4.

Figure 8:
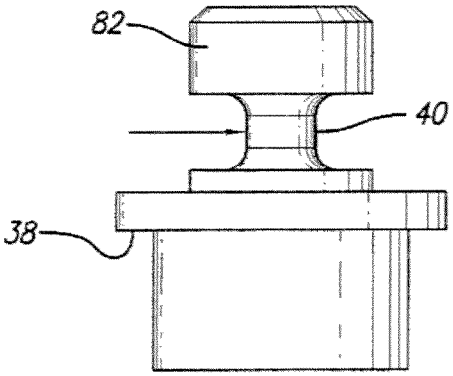
FIG. 8 is plan view of the valve stem as shown in FIG. 7.
Figure 7:
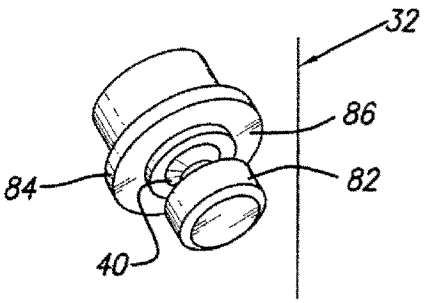
FIG. 7 is a perspective view of a valve stem used in the valve of the present invention.

In FIGS. 7 and 8 the stem is shown in greater detail. As is therein shown, the stem 32 having the groove 40 formed therein includes the head 82 and a flange 84. The surface 86 of the flange abuts the lower surface 88 of the retainer 36 and is retained in contact therewith by the force of the spring 30. The groove 40 is formed between the head 82 and the flange 84 of the stem 32 and as above described receives the o-ring 34 for sealing against the surface 42 of the lower portion of the bore 80 of the retainer 36.

Figure 9:
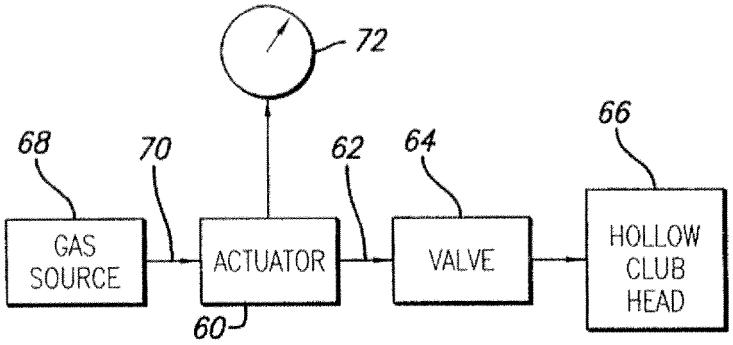
FIG. 9 is a block diagram illustrating a system for pressurizing the golf club head of the present invention.

By referring now more particularly to FIG. 9 there is shown schematically a system for pressurizing the hollow interior 20 of the club head 12. As is therein illustrated, there is provided an actuator 60 which includes means 62 for attaching the actuator to the valve 64 which in turn is inserted into the cavity 44 of the hollow club head 66 as shown in FIG. 4. As is illustrated in FIG. 5, a gas source 68 is affixed to the actuator 60 as illustrated at 70. An appropriate gauge 72 is also attached to the actuator 60 to monitor the pressure which is built up inside the hollow club head 66. To pressurize the hollow club head 66 the actuator is attached to the internal threads 53 on the retainer 36 and the gas source 68 is then attached to the actuator 60. Thereafter, the actuator 60 is manipulated in such a manner that a plunger enters the retainer 36 and engages the surface 78 of the stem 32 to move it from its closed position as illustrated in FIG. 4 to an open position thus allowing the gas from the source 68 to pass through the valve 64 into the interior of the hollow club head 12. When the gauge 72 indicates that the correct amount of pressure has been generated to properly pressurize the hollow interior 20 of the club head 12, the actuator is deactivated to allow the valve to return to its closed position as illustrated in FIG. 4. The hollow club head is then removed from the actuator and the pressurized golf club is ready for utilization.

Figure 10:
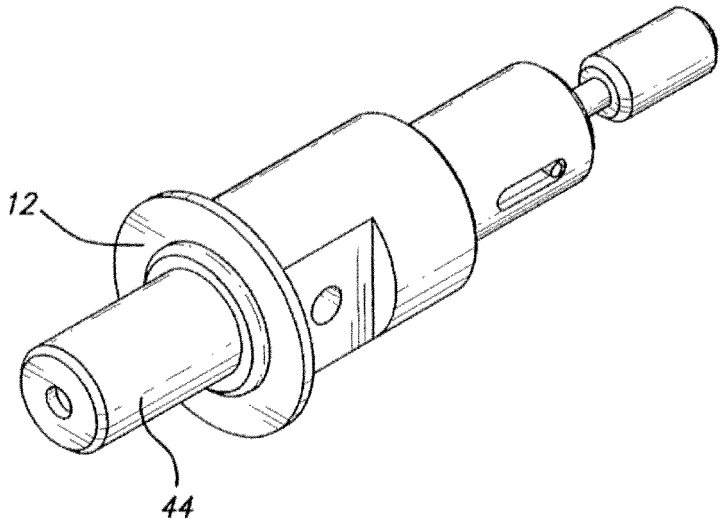
FIG. 10 is a perspective view of a charging system connected to the golf club head.
Figure 12:
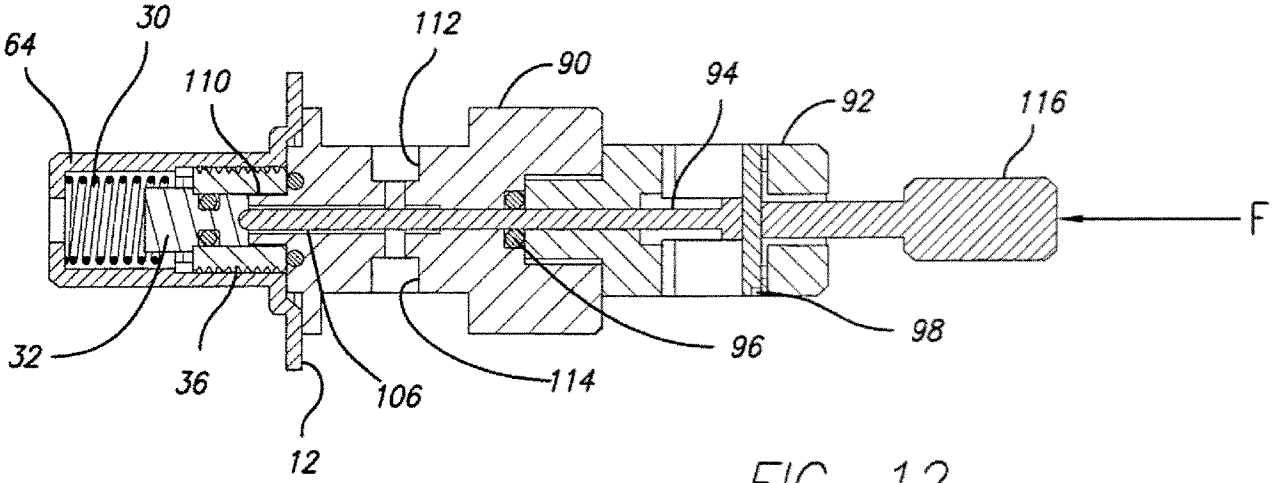
FIG. 12 is a cross-sectional view of the charging system shown in FIG. 11 taken about the lines 12-12 thereof.
Figure 13:
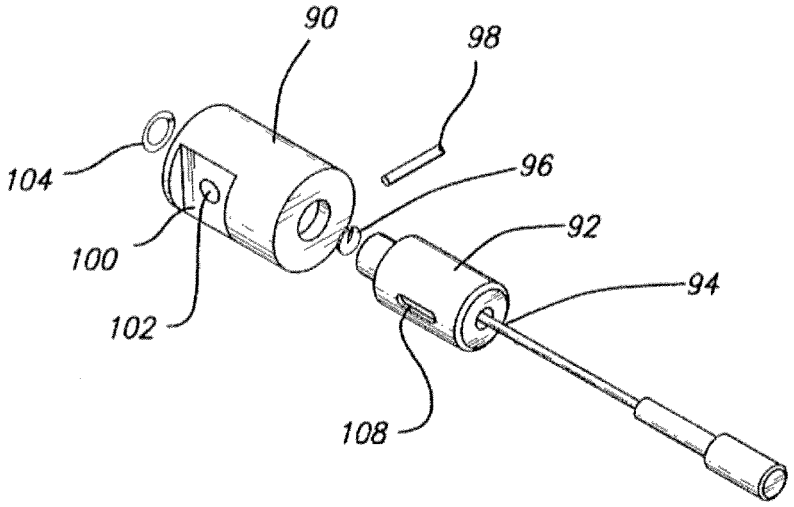
FIG. 13 is an exploded view showing the various components of the charging system used in accordance with the present invention.

Although any apparatus desired by one skilled in the art which will function in accordance with the flow diagram shown in FIG. 9 and the above description may be utilized, one form of such a fixture is illustrated in FIGS. 10 and 13 to which reference is hereby made. As is therein shown, the fixture includes a body 90 having a cap 92 which receives an actuator rod 94. An o-ring 96 is utilized to provide a seal between the cap 92 and the body 90 when the cap is secured thereto. A stop 98 cooperates with the actuator 94 and the body 92 as will be described more fully below. A recess or flat 100 is provided in the body 90 and an orifice 102 is defined therein. An additional o-ring 104 is utilized to seal the body 90 to the valve as is illustrated more fully in FIG. 12.

Figure 11:
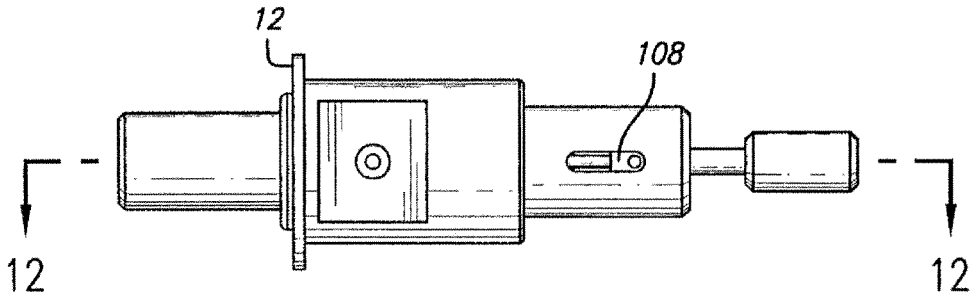
FIG. 11 is a plan view of the charging system as shown in FIG. 10.

FIG. 10 illustrates the structure as shown in FIG. 13 assembled and attached to the valve which is disposed within the recess 44 formed in the club head 12 which is schematically represented in FIG. 10. The mechanism described above is illustrated further in FIG. 11 in a plan view thereof. It is also illustrated in further detail in FIG. 12 which is a cross-sectional view taken about the lines 12-12 of FIG. 11 and illustrates in greater detail the manner in which the apparatus or fixture is attached to the valve 64. As is therein shown, the body 90 defines a bore 106 therethrough within which the actuator rod 94 is disposed. The cap 92 is threadably received within the body 90 and it is sealed therein by the o-ring 96. The stop 98 extends through the rod 94 and is disposed to reciprocate within a slot 108 formed within the cap 92. As is illustrated, the body 90 is affixed to the retainer by way of the threads 110 formed thereon which engage the threads 53 formed in the upper portion of the retainer 36. The source of gas 68 may be attached to the opening 112 while a gauge may be attached to the opening 114 in the body 90.

In operation the source of gas under pressure attached to the body 90 would be open to permit gas to enter the bore 106 within the body 90. The actuator rod would be manipulated toward the left as shown in FIG. 12 by applying a force F to the end 116 thereof. The rod would then move within the slot 108 toward the left until it bottomed out at the end thereof which would cause the valve stem 32 to move toward the left as shown in FIG. 12 thereby disengaging the o-ring from the internal surface of the retainer 36. When such is done, gas would flow from the source thereof through the bore 106 and into the hollow interior of the golf club. When the desired pressure as indicated by the gauge is reached, then the force F would be removed and the spring 30 would return the stem 32 to the position shown in FIG. 12 at which point the gas source would be removed and the fixture as shown in FIG. 13 threadably removed from the club head. At this time the internal hollow volume of the club head is filled with gas at the desired pressure. If desired, a protective cap (not shown) may be secured in place over the valve entrance to prevent tampering or other manipulation of the valve disposed in the sole plate of the club head.

Figure 14:
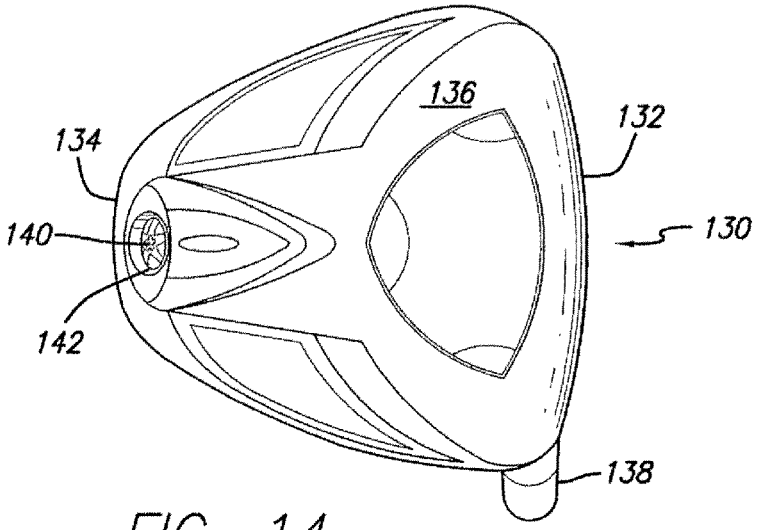
FIG. 14 is a bottom view of a driver showing the valve and a protective cover.

FIG. 14 illustrates a driver club head which has the valve as above-described located at the rear thereof adjacent the sole plate. The head 130 has a face 132 and a rear 134 with a soleplate 136. Extending from the head is the hosel 138. A valve 140 is affixed to the lower rear portion of the head adjacent the rear of the sole plate 136. A protective member such as a cover 142 or cap is affixed to the sole plate and surrounds the valve. The protective member prevents the user from tampering with the valve. Although the protective cover 142 is shown as a cylinder, it should be understood that it can take any geometric form desired.

By utilization of the pressurization system above described hollow golf club heads having face plates of relatively minimum thickness on the order of 1.0 to 2.8 millimeters may be pressurized at various pressures to counteract the forces generated by the face plate contacting a golf ball at various club head speeds. It will be understood by those skilled in the art that these thinner face plates are supported by the compressed gas housed in the hollow club head to provide maximum performance for the golfer while still remaining within the limitations set forth by the regulations of the USGA. As an example, if a golfer's measured swing speed is 60 to 65 mph, then utilizing a 2.2 millimeter club face thickness, the pressurized gas internally of the hollow club head would be less than 150 lbs. per square inch. On the other hand, as the club head speed generated by the golfer increases, the amount of pressure internally of the hollow club head would increase to support the thinner face while permitting maximum performance of the club face to obtain the benefits of the present technology. Such a process would continue until a golfer having a club head speed exceeding 90 mph necessitates the pressure internally of the hollow club head to be greater than 150 psi and preferably would be between 150 and 300 psi to support the thinner club face and thus preclude damage to it even though a greater amount of force is generated upon impact of the club face with the golf ball. It will be recognized by those skilled in the art that through utilization of a system where club head speed is correlated to club face thickness and internal pressurization of the hollow club head, golfers may be fitted with the proper club to provide the greatest performance for each golfer irrespective of club head speed.

Utilizing the principles of the present invention a hollow club head having a face plate that will compensate for off center strikes may be accomplished. Areas of reduced thickness of the face plate may be formed displaced from the center of the face plate toward the heel, toe, top or bottom thereof. These reduced thickness areas allow the off center strike to still be in a so-called "sweet spot" of the club face thereby providing better performance of the golf club even with off-center strikes. The reduced thickness areas are supported by the compressed gas housed internally of the hollow club head.

Since the advent of metal hollow clubs, particularly drivers, it has been recognized by the golfers that a rather loud metallic sound occurs when the club head strikes the ball. As club heads have gotten larger and larger generating a greater hollow interior space, this sound has increased dramatically. With the advent of the new square shaped club heads the sound created by the impact of the club head against the ball is even further enhanced. It has been determined that this increased sound is somewhat disconcerting to the golfers and efforts are being made to mitigate that sound. It has been discovered that through utilization of the principles of the present invention and by pressurizing the interior hollow cavity of the club head with a compressed gas, particularly the driver, that the sound generated upon impact of the club head with the ball is substantially mitigated. When the thermoplastic coating is applied to the interior surface of the hollow club head, the sound generated is even further mitigated.

Although the foregoing description has been made with emphasis on drivers and fairway woods, it is to be understood that the principles of the present invention are equally applicable to the hybrid clubs and also to irons which may be manufactured with a cavity between the club face and the rear of the club. By utilization of the principles of the present invention a thinner club face may be utilized on the irons thus providing an enhanced performance of the irons.

There has thus been disclosed a hollow metal golf club head having the interior thereof filled with a gas under pressure which includes a valve disposed within a cavity formed at the time of the manufacture of the club head and which may be reciprocated between a sealed and opened position to allow gas under pressure to enter the hollow interior of the club. The interior surface of the club is covered with a solid plastic material to seal pores which may occur within the material from which the hollow club head is formed. Also disclosed is a system for charging the hollow interior of the club head with pressurized gas to thereby allow the fitting of golf clubs having face plates on the order of 1.1 millimeter to 2.8 millimeters in thickness with compressed gas having pressure on the order of 20 to 300 lbs. per square inch to tailor the golf club to swing speeds between 40 mph and 160 mph.

What is claimed is:

1. A method for manufacturing a golf club head comprising:

providing a hollow golf club head having an interior surface;

injecting a sealant material into said hollow golf club head;

rotating said golf club head simultaneously through a vertical and horizontal axis to thereby coat said interior surface with said sealant material;

said sealant material solidifying within said golf club head;

filing said hollow golf club head with a gas under pressure; and providing a valve having a plunger movable between open and closed positions carried by said hollow golf club head, moving said plunger to its open position to fill said hollow head with gas and moving said plunger to its closed position.

2. The method as defined in claim 1 wherein said gas is nitrogen.

3. The method as defined in claim 1 wherein the pressure of said gas is 20 to 300 pounds per square inch.

4. The method as defined in claim 3 which further includes measuring the pressure of said gas during filling of said hollow head.

* * * * *